US005896614A

United States Patent [19]

Flewitt

[11] Patent Number: 5,896,614

[45] Date of Patent: Apr. 27, 1999

[54] BRISTLE ARRANGEMENT FOR A TOOTHBRUSH

[75] Inventor: Harry Flewitt, Farnham, United Kingdom

[73] Assignee: SmithKline Beecham p.l.c., Brentford, United Kingdom

[21] Appl. No.: 08/836,334

[22] PCT Filed: Nov. 15, 1995

[86] PCT No.: PCT/EP95/04513

§ 371 Date: Aug. 15, 1997

§ 102(e) Date: Aug. 15, 1997

[87] PCT Pub. No.: WO96/15696

PCT Pub. Date: May 30, 1996

[30] Foreign Application Priority Data

Nov. 19, 1994 [GB] United Kingdom ..... 9423421

[51] Int. Cl.[6] ..... A46B 9/04

[52] U.S. Cl. ..... 15/167.1; 15/207.2

[58] Field of Search ..... 15/110, 167.1, 15/207.2, DIG. 6

[56] References Cited

U.S. PATENT DOCUMENTS 2,599,191 6/1952 Meunier .

FOREIGN PATENT DOCUMENTS

A 27 28 672 11/1979 Germany .
WO 94/09677 11/1994 WIPO .

*Primary Examiner*—Terrence R. Till
*Attorney, Agent, or Firm*—Nora Stein-Fernandez; Janice E. Williams

[57] ABSTRACT

A toothbrush, wherein the head has a face from which project one or more strips of a flexible and resilient material, preferably combined with bristles and arranged in rows or groups of rows of the strips alternating with the rows or groups of rows of the bristles. The strips enhance the tooth cleaning effect of the toothbrush.

9 Claims, 4 Drawing Sheets

BRISTLE ARRANGEMENT FOR A TOOTHBRUSH

FIELD OF THE INVENTION

This invention relates to novel devices, namely toothbrushes.

BACKGROUND OF THE INVENTION

Toothbrushes generally comprise a head and a handle disposed along a longitudinal axis, the head having a substantially planar face from which project a plurality of bristles. The bristles of known toothbrushes are generally filaments of generally circular cross section, ideally with rounded ends, grouped together in tufts of generally circular cross section.

Toothbrushes are known which include cleaning filaments other than bristles, either as a complete alternative to bristles, or in addition to bristles. For example U.S. Pat. No. 4,277,862 discloses a toothbrush having resilient gum massage elements along the outer edges of the bristle pattern. U.S. Pat. No. 4,616,374 discloses a toothbrush having a brush head composed of nylon mesh or loops. U.S. Pat. No. 5,040,260 discloses a toothbrush having a head from which extend small rubber cones. GB 2214420A discloses a toothbrush having a head from which project small rubber pyramids. GB 214701 discloses a toothbrush having cleaning elements comprised of strips of crepe rubber, in one theoretically discussed embodiment of which the strips may have bristles sandwiched between the sheets of crepe rubber.

This invention provides a toothbrush having tooth cleaning filaments, of a different cross section to known bristles and tufts.

SUMMARY OF THE INVENTION

According to this invention a toothbrush comprises a head and a handle disposed along a longitudinal toothbrush axis, the head having a face (the "bristle face") from which project, in a length direction substantially perpendicular to the bristle face, one or more strips of a flexible and resilient material having a width direction, perpendicular to the length direction, which is greater than the thickness, perpendicular to the width direction, of the strips, provided that if the width direction of the said strips is substantially parallel to the longitudinal axis, the said strips are combined with bristles, and are arranged in rows or groups of rows of the said strips alternating with rows or groups of rows of the said bristles, and/or are combined with strips which have their width dimension aligned at an angle to the longitudinal axis.

The bristle face may be substantially planar.

The length of the strips may be substantially the same as that of conventional toothbrush bristles and tufts. If the toothbrush includes combinations of bristles and strips, the length of the bristles and strips may be the same, or alternately the strips may be longer or shorter than the bristles, so as to present an undulating profile of longer bristles and shorter strips, or vice versa. Such an undulating profile can assist in cleaning the surfaces of the teeth, particularly the interdental surfaces. Additionally or alternatively the length of the strips may vary across their width, so that the ends of the strips may not be coplanar with the bristle face. For example the profile of the ends of widthways adjacent strips may present a concave "V" or "U" shaped profile or other concave profile. Alternatively the ends of adjacent strips may present a convex profile. In these ways the ends of the strips may be more closely accommodated to the surfaces of the teeth they are to clean, and/or to fit into the interdental spaces. The strips may be substantially parallel sided, or alternately they may taper along their length, being either wider or narrower at their end remote from the bristle face than at their base at the bristle face. The thickness of the strips can be typically 0.2 or less, e.g. 0.1 or less than the width of the strips. For example the width of the strips may be substantially the same as the cross sectional width of conventional tufts of bristles e.g. 0.5–2.0 mm.

DETAILED DESCRIPTION OF THE INVENTION

In one embodiment, the width direction of the strips may be aligned substantially perpendicular to the longitudinal axis of the toothbrush, i.e. across the width of the face of the toothbrush head. In this embodiment the width dimension may be substantially less than the width dimension of the face, for example so that two or more, e.g. three or more such strips may lie in line or staggered abreast across the width of the toothbrush face. Alternatively the width dimension of the strips may be a substantial proportion of the width of the face, e.g. 50% thereof or more, so that a single strip occupies substantially the entire width or a substantial proportion of the entire width of the face.

In this first embodiment of the invention, because the width of the strips is greater than the thickness of the strips, the strips will have a greater resistance to bending in a direction across the width of the face than to bending in a direction parallel to the longitudinal axis. This can have an advantageous effect on cleaning efficiency.

In a second, preferred, embodiment of this invention, the width dimension of the strips may be aligned substantially parallel to the longitudinal axis of the toothbrush provided that if the width direction of the said strips is substantially parallel to the longitudinal axis, the said strips are combined with bristles, and are arranged in rows or groups of rows of the said strips alternating with rows or groups of rows of the said bristles.

In this embodiment the width dimension of the strips may be substantially less than the length of the face, for example, so that two or more, e.g. five or more such strips may lie in line or staggered along the length of the face. Alternatively the width of the strips may be a substantial proportion of the length of the face, e.g. 50% or more of the length of the face so that for example only one or two strips lie in line or staggered along the length of the face.

In this second embodiment of the invention, the strips will have a greater resistance to bending in a direction along the length of the face than to bending in a direction perpendicular to the longitudinal axis. This too can have an advantageous effect on cleaning efficiency.

In a third embodiment of the invention, in particular that in which the width direction of the said strips is substantially parallel to the longitudinal axis, the toothbrush may include the above-described strips combined with tufts of bristles, for example, in alternating rows, groups of rows, or other patterns. Such tufts may be of generally conventional circular section, or additionally or alternatively such tufts may be "mats" of bristles of other than circular sections, e.g. of the shapes generally disclosed in WO 95/06420. Rows and groups of rows of strips may extend across the width of the head of the toothbrush, i.e. perpendicular to the longitudinal axis, such that although some such strips may be located at the outside edge of the strip/tuft pattern on the head, others are located between these outer edge strips or bristles. For example a row or group of rows of strips may be arranged between tufts located on the outer edge of the bristle/strip pattern, so that the strips occupy a generally inner position in the bristle/strip pattern relative to the longitudinal axis, between flanking tufts of bristles at the outer edges of the pattern.

In one version of this third embodiment, the toothbrush of this invention comprises a distal row or group of rows of tufts of bristles at the end of the toothbrush head remote from the handle, a proximal row or group of rows of tufts of bristles at the end of the toothbrush head nearest to the handle, an intermediate row or group of rows of tufts of bristles between the distal and proximal tufts, for example around the longitudinal mid point of the head, with a row or group of rows of strips between both the distal and intermediate tufts and between the intermediate and proximal tufts.

In this version for example the distal tufts may be arranged in a substantially circular cluster. In this version for example the strips may be arranged in groups of rows, e.g. two rows in each group, the rows extending transversely across the width of the toothbrush head, i.e. perpendicular to the longitudinal axis of the toothbrush. In this version for example the bristles may be longer than the strips, so that the bristles act in the interdental spaces and the strips clean the broad surfaces of the teeth.

In a further embodiment of the invention, the toothbrush may include both strips which have their width substantially perpendicular to the longitudinal axis, and strips which have their width substantially parallel to the longitudinal axis, having for example dimensions as described above.

In a further embodiment of the invention, the toothbrush may include strips which have their width dimension aligned at an angle other than perpendicular to or parallel to the longitudinal axis, for example at 30°–60° to the longitudinal axis.

The strips may be made of the materials from which conventional bristle filaments are made, for example nylon or other plastics materials known to those in the art. Alternatively the strips may be made of softer plastics or elastomeric materials, e.g. synthetic rubbers. The strips may be fixed into the head of the toothbrush in a manner analogous to the way in which conventional tufts are fixed in, e.g. by small metal clips retained by wedging into a socket hole, in the face. Alternatively the strips may be fixed in by the use of known welding or moulding techniques in which an end of the strip is fused with the material of the head. The strips may be coloured in a contrasting colour to the head of the toothbrush, or to bristles if present, to visually emphasise the novel construction of the toothbrush. The ends of the strips remote from the bristle face may be rounded, or may terminate in bulbous ends to help to eliminate any possibility of gum injury, particularly if the strips are made of relatively stiff plastics materials.

The remainder of the toothbrush, and conventional bristles if included, may be of essentially known construction and materials. For example the toothbrush of the invention may include the "U" shaped folds disclosed in EP 0336641A in its handle, and/or a cut out between its head and handle containing an elastomeric material as disclosed in WO 92/17092.

The toothbrush of the invention provides the advantage of improved tooth cleaning efficiency, as the strips act to wipe the tooth surfaces. This wiping action is not carried out by the small rubber pyramids and cones of the earlier publications discussed above. A further advantage of the use of the strips in the toothbrushes of the invention is that the problem of build up of bacterial and other microorganism growth which can occur with tufts of bristles in tufts, the structure of which can retain moisture by capillary action, and detritus, is less likely to occur.

The invention will now be described by way of example only with reference to the accompanying drawings:

DETAILED DESCRIPTION OF THE DRAWINGS

Figure 1:
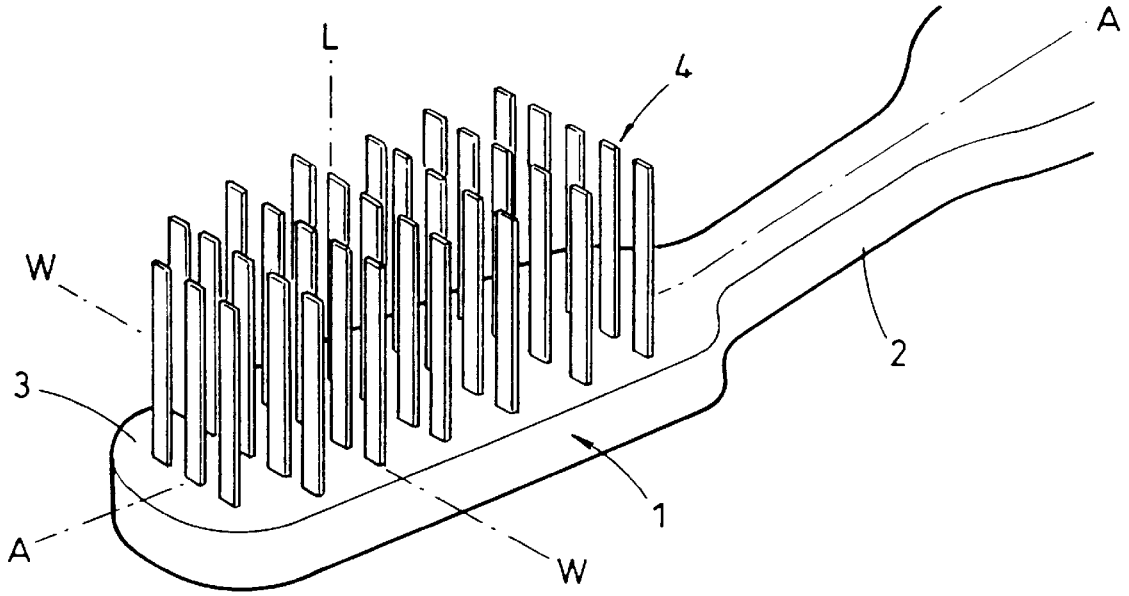
FIG. 1 shows a perspective view of the head of a toothbrush of this invention, and the adjacent region of the handle.
Figure 2:
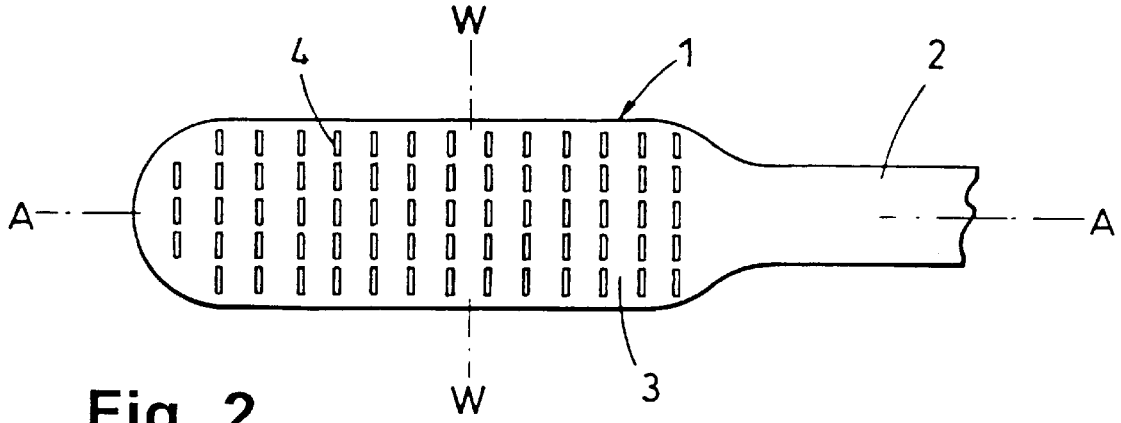
FIGS. 2–4 show plan views of the head of toothbrushes of this invention.

Referring to FIGS. 1 and 2, the head 1 and the adjacent part 2 of the handle of a toothbrush are shown, disposed along a longitudinal axis A—A. The head 1 has a substantially planar face 3. Mounted in the face 3, for example in sockets (not shown) in the face 3, are strips 4 of a resilient plastics material such as nylon. The strips 4 project in a length direction L substantially perpendicular to the face 3.

Figure 1A:
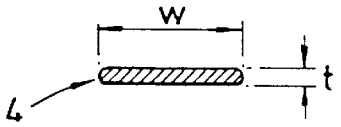

Referring to FIG. 1A, an enlarged cross section about the length direction L through one of the strips 4 is shown. The strip 4 has a width dimension w of about 1.5 mm and a thickness t of about 0.2 mm. Strips 4 used in the toothbrushes of this invention may of course have other dimensions appropriate to the head they are used on.

The strips 4 are arranged in rows abreast in the face 3, with their width dimension w aligned parallel to the width direction W—W of the face 3, perpendicular to the longitudinal axis A—A.

Figure 3:
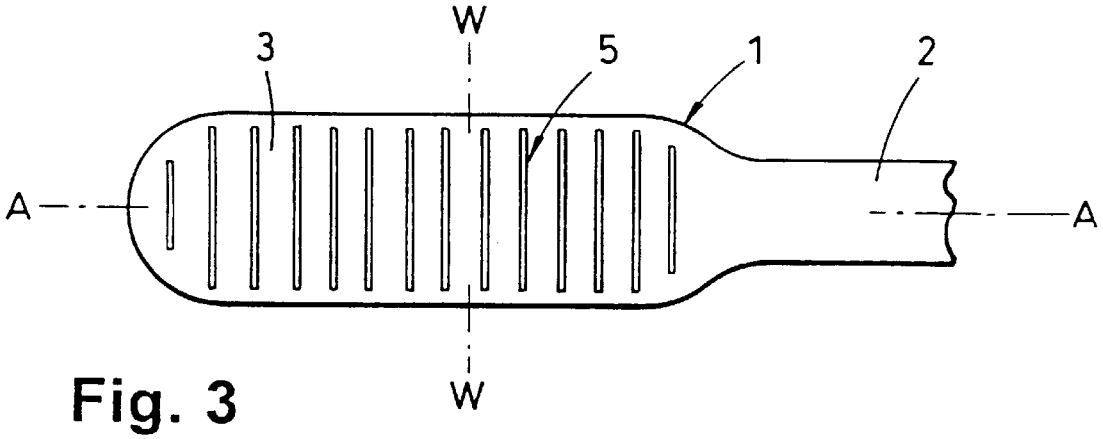

Referring to FIG. 3 the head 1 and adjacent part 2 of the handle of a toothbrush are shown in a plan view. In this embodiment strips 5 are mounted in the face 3 of the head, and the width dimension w of the strips 5 is substantially the same as the width direction W—W of the face 3, so that the width direction W—W is occupied substantially by the width of a single strip 5.

Figure 4:
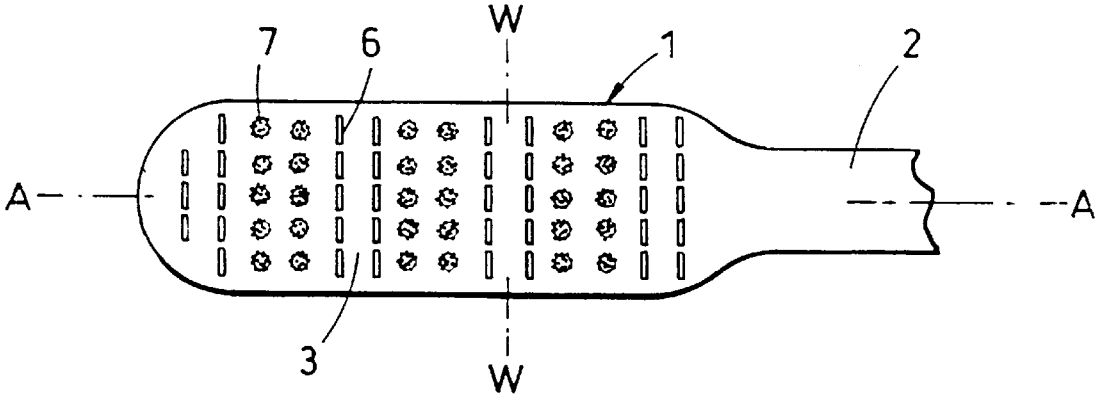

Referring to FIG. 4, the head 1 and adjacent part 2 of the handle of a toothbrush are shown in plan view. Strips 6, similar in shape, size and construction to those 4 of FIG. 1 are mounted in the face 3, with their width dimension w parallel to the width direction W—W of the head. In the face 3 are also mounted conventional circular sectioned tufts 7 of bristles, in rows abreast across the width direction W—W of the head.

In the toothbrushes of FIGS. 1–4 the strips 4, 5, 6 bend relatively easily in a direction parallel to the longitudinal axis A—A of the toothbrush, but with relative difficulty in a direction perpendicular to the longitudinal axis A—A.

Figure 5:
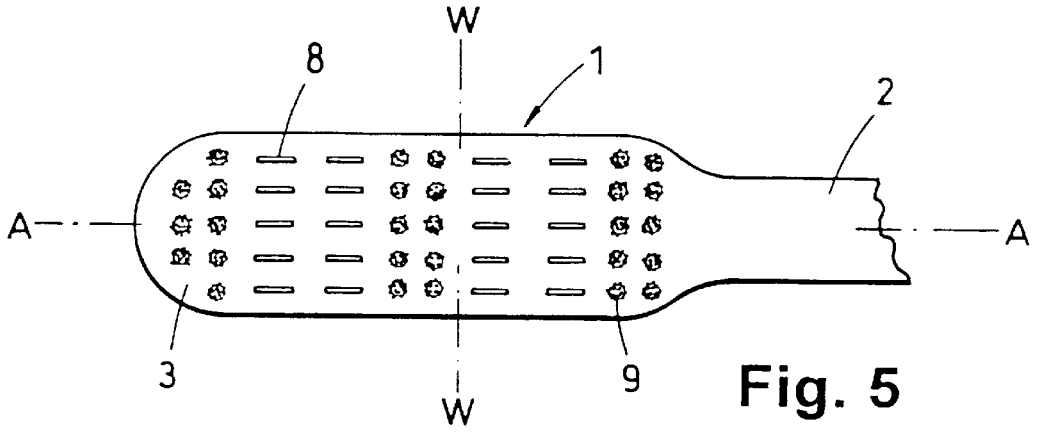
FIGS. 5 and 6 show plan views of the heads of toothbrushes of this invention.

Referring to FIG. 5, the head 1 and adjacent part 2 of the handle of a toothbrush are shown. Mounted in the face 3, for example in sockets (not shown), in the face 3, are strips 8 of a resilient plastics material such as nylon. The strips 8 project in a length direction L substantially perpendicular to the face 3. The shape, size and cross section of the strips 8 is similar to that shown in FIG. 1A. The strips 8 are arranged in widthways rows of strips 8 in line longitudinally in the face 3, with their width dimension w—w parallel to the longitudinal axis A—A of the toothbrush. In the face 3 are also mounted conventional circular sectioned tufts 9 of bristles, in rows abreast across the width direction W—W of the head.

Figure 6:
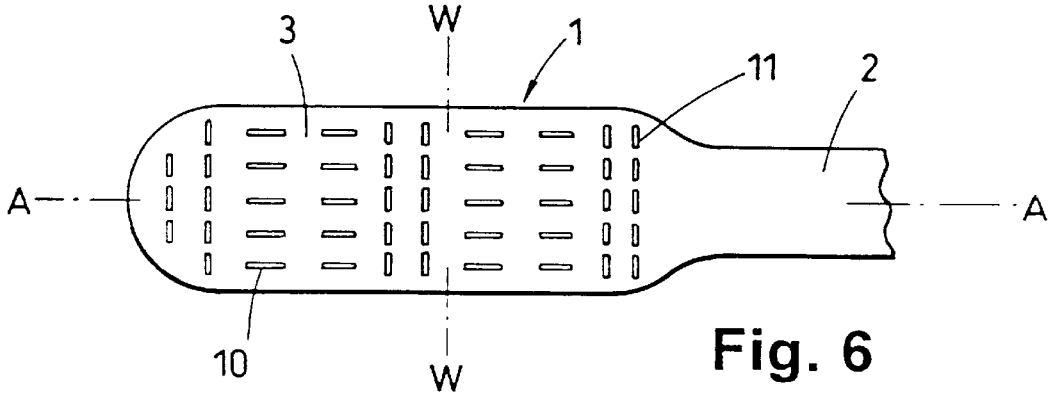

Referring to FIG. 6, the head 1 and adjacent part 2 of the handle of a toothbrush are shown. Strips 10, similar in shape, size, construction and alignment to the strips 4 of FIG. 1, with their width dimension w perpendicular to the width direction W—W of the head, i.e. at a paralled angle to the longitudinal axis A—A, are mounted in the face 3. Strips 11, similar in construction to the strips 8 of FIG. 5 are also mounted in the face 3 and with their width direction w perpendicular to the longitudinal axis A—A of the head. The alignment of the strips 11 is substantially perpendicular to that of the strips 10.

Figure 7:
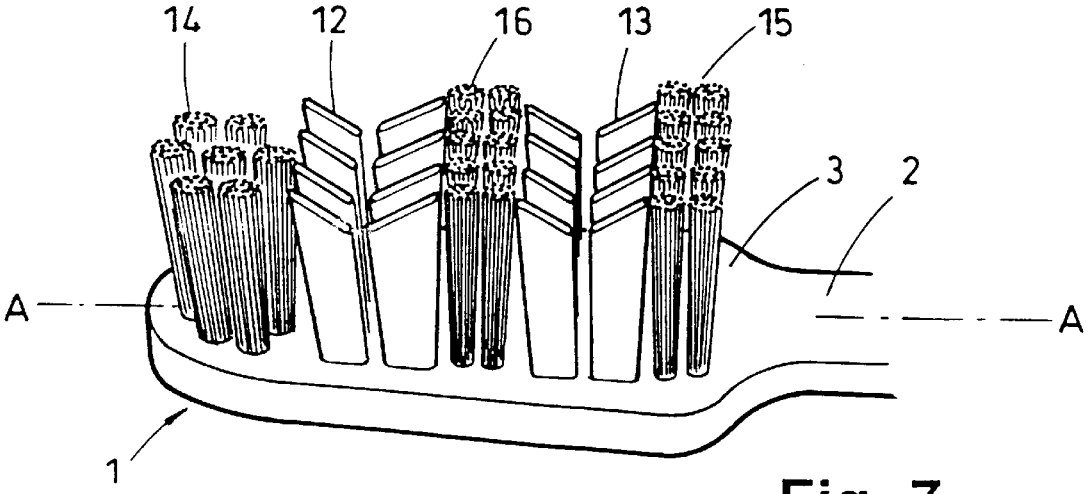
FIG. 7 shows a perspective view of the head of a toothbrush of this invention, and the immediately adjacent region of the handle.

Referring to FIG. 7, the head 1 and adjacent part 2 of the handle of a toothbrush similar in construction to that of FIG. 5 are shown in a perspective view. Strips 12 and 13 (generally) are mounted in the face 3, with their width dimension w, parallel to the longitudinal axis A—A. In the face 3 are also mounted conventional circular sectioned tufts 14, 15 and 16 (generally) of bristles in substantially circular sectioned tufts. There is a distal group of rows of tufts 14 at the end of the toothbrush head 1 remote from the handle 2, arranged in a substantially circular cluster of six tufts 14 around a central tuft 14; a proximal group of rows of tufts of bristles 15 at the end of the toothbrush head 1 nearest to the handle 2, and an intermediate group of rows of tufts of bristles 16 between the distal and proximal tufts 14, 15, around the longitudinal mid point of the head. The pattern of the distal tufts 14 could for example be varied, e.g. so that other than six tufts 14 surround the central tuft 14. Additionally or alternatively the numbers of intermediate 16 and distal 15 tufts could be different to the five shown in each row.

The strips 12, 13 are arranged in groups of two rows of strips extending transversely across the width of the toothbrush head, located between both the distal 14 and intermediate 16 tufts and between the intermediate 16 and proximal tufts 15. The length of the strips 12, 13 varies across their width, i.e. along the longitudinal axis A—A of the toothbrush, so that the ends of the strips are not coplanar with the bristle face, but so that longitudinally adjacent strips 12, 13 present a "V" shaped profile, with the tufts 14, 15 and 16 at peaks in the tuft/strip pattern. The strips 12, 13 taper along their length, being wider at their end remote from the bristle face 3 than at their base at the bristle face 3.

Although in the toothbrush of FIG. 7 four individual strips 12, 13 are arranged in rows in line abreast across the head 1, other numbers of strips, e.g. three, five or six could be arranged in such rows. Additionally or alternatively this arrangement could be modified such that each strip 12, 13 is itself a cluster of thinner strips, and a number, e.g. four, of such clusters could be arranged in line abreast across the head.

In use in toothbrushing, the tufts 16 of the toothbrush of FIG. 7 clean the interdental spaces, because being arranged at peaks they can easily enter the concavities of the interdental spaces. The "V" shaped profile of the strips 12, 13 more easily contact the broad convexities of the broad surfaces of the teeth and clean them by wiping them.

In the toothbrushes of FIGS. 5–7, the strips 8, 10, 12, and 13 bend relatively easily in the width direction W—W of the head, but with relative difficulty in the direction parallel to the longitudinal axis A—A. In use, the strips 4, 5, 6, 8, 10, 11, 12, and 13 enhance the tooth cleaning of the toothbrush.

Figure 8:
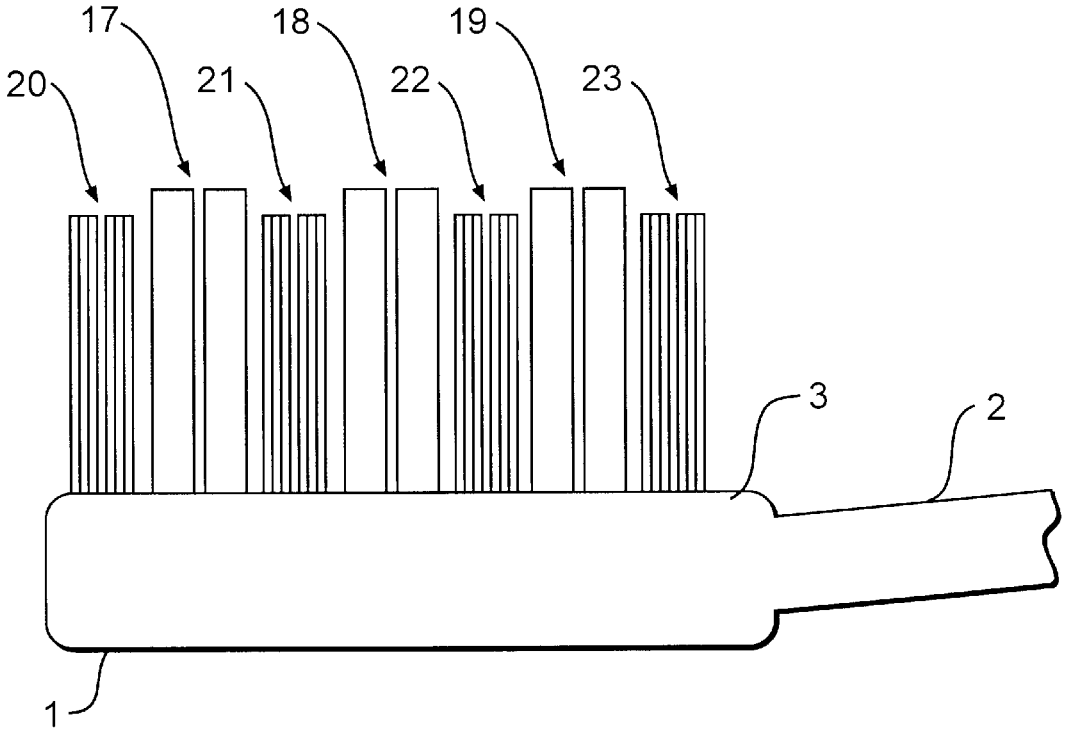
FIG. 8 shows a side view of another embodiment of the head of the toothbrush of the invention and the immediately adjacent region of the handle.

Referring to FIG. 8, the head 1 and adjacent part 2 of the handle of a toothbrush similar in construction to that of FIG. 7 are shown in a side view. Strips 17, 18 and 19 (generally) are mounted in the face 3, with their width direction, parallel to the longitudinal axis A—A. In the face 3 are also mounted conventional circular sectioned tufts 20, 21, 23 and 23 (generally) of bristles. In the toothbrush of FIG. 8, the strips 17, 18 and 19 bend relatively easily in the width direction of the head, but with relative difficulty in the direction parallel to the longitudinal axis A—A. In use, the strips 17, 18 and 19 enhance the tooth cleaning of the toothbrush.

I claim:

1. A toothbrush comprising a head and a handle disposed along a longitudinal toothbrush axis, characterized in that the head has a face from which project, in a length direction substantially perpendicular to the bristle face, one or more strips of a flexible and resilient material having a width direction, perpendicular to the length direction, which is greater than the thickness, perpendicular to the width direction of the strips, the width direction of the strips being substantially parallel to the longitudinal axis, the strips being combined with bristles and being arranged in at least one row of the strips aligned across the longitudinal axis of the toothbrush, and longitudinally alternating with at least one row of the bristles.

2. A toothbrush according to claim 1 wherein the toothbrush includes combinations of bristles and strips.

3. A toothbrush according to claim 1 or 2 wherein the strips differ in length to the bristles, so as to present an undulating profile of longer bristles and shorter strips, or vice versa.

4. A toothbrush according to claim 1 wherein the length of the strips varies across their width, so that the ends of the strips are not coplanar with the face from which the strips project.

5. A toothbrush according to claim 4 wherein the profile of the ends of widthways adjacent strips presents a concave "V" or "U" shaped profile.

6. A toothbrush according to claim 1 having at least one distal row of tufts of bristles at the end of the toothbrush head remote from the handle, at least one proximal row of tufts of bristles at the end of the toothbrush head nearest to the handle, at least one intermediate row of tufts of bristles between the distal and proximal tufts, and at least one row of strips between both the distal and intermediate tufts and between the intermediate and proximal tufts.

7. A toothbrush according to claim 1 which includes strips which have their width dimension aligned other than perpendicular to or parallel to the longitudinal axis.

8. A toothbrush comprising a head and a handle disposed along a longitudinal toothbrush axis, characterized in that the head has a face from which project, in a length direction substantially perpendicular to the bristle face, one or more strips of a flexible and resilient material having a width direction, perpendicular to the length direction, which is greater than the thickness, perpendicular to the width direction, of the strips, the width direction of the strips being aligned substantially perpendicular to the longitudinal axis of the toothbrush.

9. A toothbrush according to claim 1 which includes both strips which have their width substantially perpendicular to the longitudinal axis, and strips which have their width substantially parallel to the longitudinal axis.

* * * * *